US011165192B2

(12) United States Patent
Zhang

(10) Patent No.: US 11,165,192 B2
(45) Date of Patent: Nov. 2, 2021

(54) PLUG

(71) Applicant: GEMMY INDUSTRIES CORPORATION, Coppell, TX (US)

(72) Inventor: Cheng-Chun Zhang, Shenzhen (CN)

(73) Assignee: GEMMY INDUSTRIES CORPORATION, Coppell, TX (US)

( * ) Notice: Subject to any disclaimer, the term of this patent is extended or adjusted under 35 U.S.C. 154(b) by 164 days.

(21) Appl. No.: 16/681,236

(22) Filed: Nov. 12, 2019

(65) Prior Publication Data

US 2021/0143573 A1 May 13, 2021

(51) Int. Cl.
*H01R 13/52* (2006.01)

(52) U.S. Cl.
CPC ..... *H01R 13/5213* (2013.01); *H01R 13/5202* (2013.01)

(58) Field of Classification Search
CPC ..... H01R 13/52; H01R 13/5202; H01R 13/5205; H01R 13/5208; H01R 13/521; H01R 13/5213; H01R 13/5219; H01R 13/5221; H01R 13/504
See application file for complete search history.

(56) References Cited

U.S. PATENT DOCUMENTS 6,297,982 B1 * 10/2001 Wu ..... H02M 7/003 363/146
7,862,380 B1 * 1/2011 Wang ..... H01R 13/52 439/620.22
8,047,873 B1 * 11/2011 Wang ..... H01R 31/065 439/589
8,337,250 B1 * 12/2012 Yang ..... H01R 13/112 439/620.22
8,619,413 B2 * 12/2013 Gausepohl ..... H01R 13/6675 361/623
2016/0043497 A1 * 2/2016 Wang ..... H01R 13/5202 439/620.21
2018/0331475 A1 * 11/2018 Yin ..... H01R 13/6683
2018/0332726 A1 * 11/2018 Zhu ..... H01R 13/5213
2018/0368272 A1 * 12/2018 Huang ..... H01R 12/718
2020/0403353 A1 * 12/2020 Chang ..... H05K 5/0069

* cited by examiner

*Primary Examiner* — Edwin A. Leon
*Assistant Examiner* — Milagros Jeancharles
(74) *Attorney, Agent, or Firm* — Rabin & Berdo, P.C.

(57) ABSTRACT

A plug has a seat, a circuit board disposed in the seat, and a waterproof terminal connector disposed on the seat. The waterproof terminal connector has two terminals and a cover. Each one of the terminals has a tube portion, a division plate, and a connecting portion. The tube portion has a chamber formed in the tube portion. The division plate is formed in the tube portion for dividing the chamber of the tube portion into a first space and a second space. The connecting portion is formed on the tube portion. The cover is formed by an overmolding process, is connected to the two terminals and fills the second spaces of the two terminals. Water vapor can be stopped by the division plate for improving the waterproof effect of the plug.

8 Claims, 7 Drawing Sheets

PLUG

BACKGROUND OF THE INVENTION

1. Field of the Invention

The present invention relates to a plug, and more particularly to a plug that may improve the waterproof effects of the plug.

2. Description of Related Art

A conventional plug has a seat, a circuit board, two pins, and a terminal connector. The seat is hollow. The circuit board is disposed in the seat. The two pins are mounted on an end of the seat and are electrically connected to the circuit board. The terminal connector is mounted on another end of the seat, is electrically connected to the circuit board, and has a cover and two terminals. The cover is mounted on the seat. The two terminals are mounted on the cover at a spaced interval and are electrically connected to the circuit board. Each one of the two terminals has a tube portion and a connecting portion. The tube portion has a chamber, a first opening, and a second opening. The chamber of the tube portion is axially formed through the tube portion. The first opening and the second opening are respectively formed in two ends of the tube portion and both communicate with the chamber of the tube portion. The second opening is closed by the cover. The connecting portion is formed on the tube portion adjacent to the second opening, is inserted into the seat, and is electrically connected to the circuit board.

The second opening of each one of the two terminals is closed by the overmolding of the cover. Materials of the cover and the two terminals are different. The cover and the two terminals are assembled together by the overmolding means. The cover cannot completely abut an inner surface of the tube portion, thereby the second opening of each one of the two terminals is not completely sealed. Water vapor easily enters the seat via the terminal connector, such that the waterproof effect of t the conventional plug is not sufficient.

To overcome the shortcomings, the present invention provides a plug to mitigate or obviate the aforementioned problems.

SUMMARY OF THE INVENTION

The objective of the invention is to provide a plug that can solve the shortcoming that the waterproof effect of the conventional plug is insufficient.

The plug has a seat, a circuit board, and the waterproof terminal connector. The seat has two end surfaces, two pins, and a connecting opening. The two pins are disposed on one of the two end surfaces of the seat. The connecting opening is formed through the other one of the two end surfaces of the seat. The circuit board is disposed in the seat and is electrically connected to the two pins.

The waterproof terminal connector has two terminals and a cover. The two terminals are disposed at a spaced interval.

Each one of the two terminals has a tube portion, a division plate, and a connecting portion. The tube portion has an inner surface, two end surfaces, a first opening, a second opening, and a chamber. The first opening is formed through one of the two end surfaces of the tube portion. The second opening is formed through the other one of the two end surfaces of the tube portion. The chamber is formed in the tube portion. The division plate is formed in the tube portion and has an outer surface connected to the inner surface of the tube portion completely for dividing the chamber of the tube portion into a first space and a second space. The first space communicates with the first opening. The second space communicates with the second opening. The connecting portion is formed on the tube portion adjacent to the second opening of the tube portion. In the waterproof terminal connector, the connecting portions of the two terminals are inserted into the seat.

The cover is formed by an overmolding process, is connected to the two terminals and fills the second space of the two terminals. The connecting portions of the two terminals protrude out of the cover.

In each one of the two terminals, the chamber of the tube portion is separated into the first space and the second space by the division plate, thereby the first space is not in communication with the second space. The second space is filled with a part of the cover. Water vapor flowing into the second space via the second opening can be stopped by the part of the cover filling the second space, and further can be stopped by the division plate to keep the water vapor from flowing into the first space and the seat. The division plate and the part of the cover filling the second space can provide the double protection for improving the waterproof effect.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
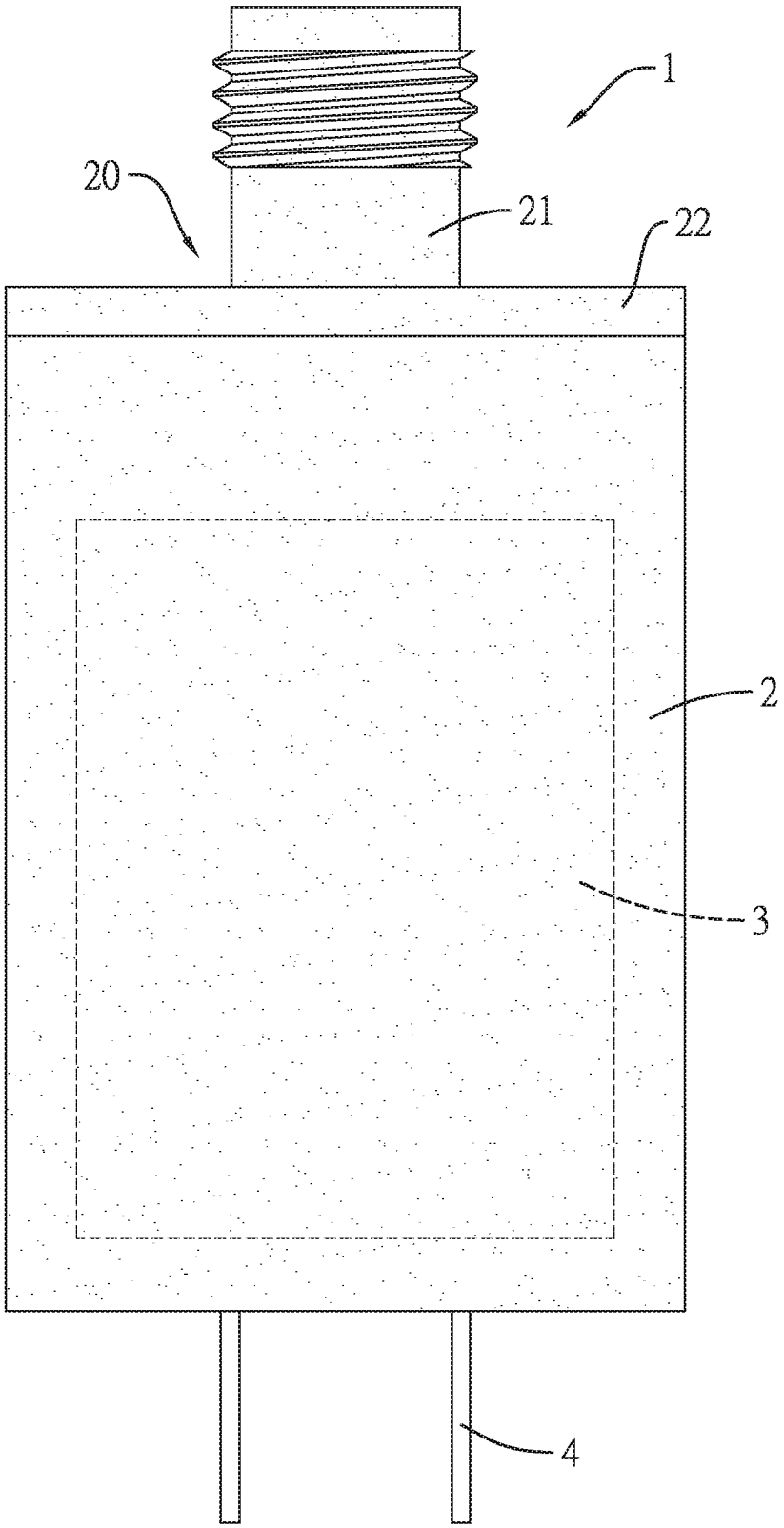
FIG. 1 is a front side view of a plug in accordance with the present invention.
Figure 2:
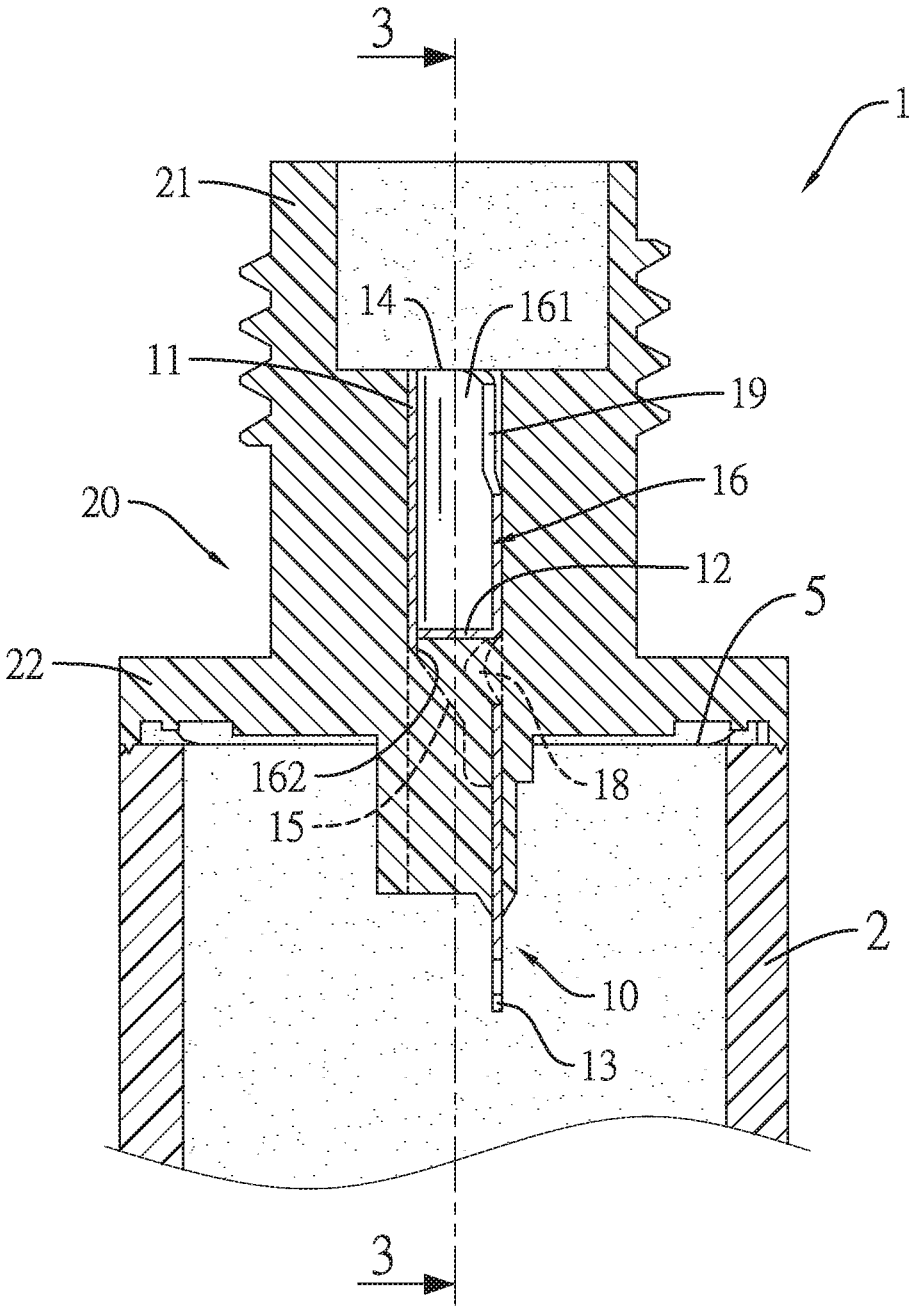
FIG. 2 is an enlarged cross sectional side view of the plug in FIG. 1.
Figure 3:
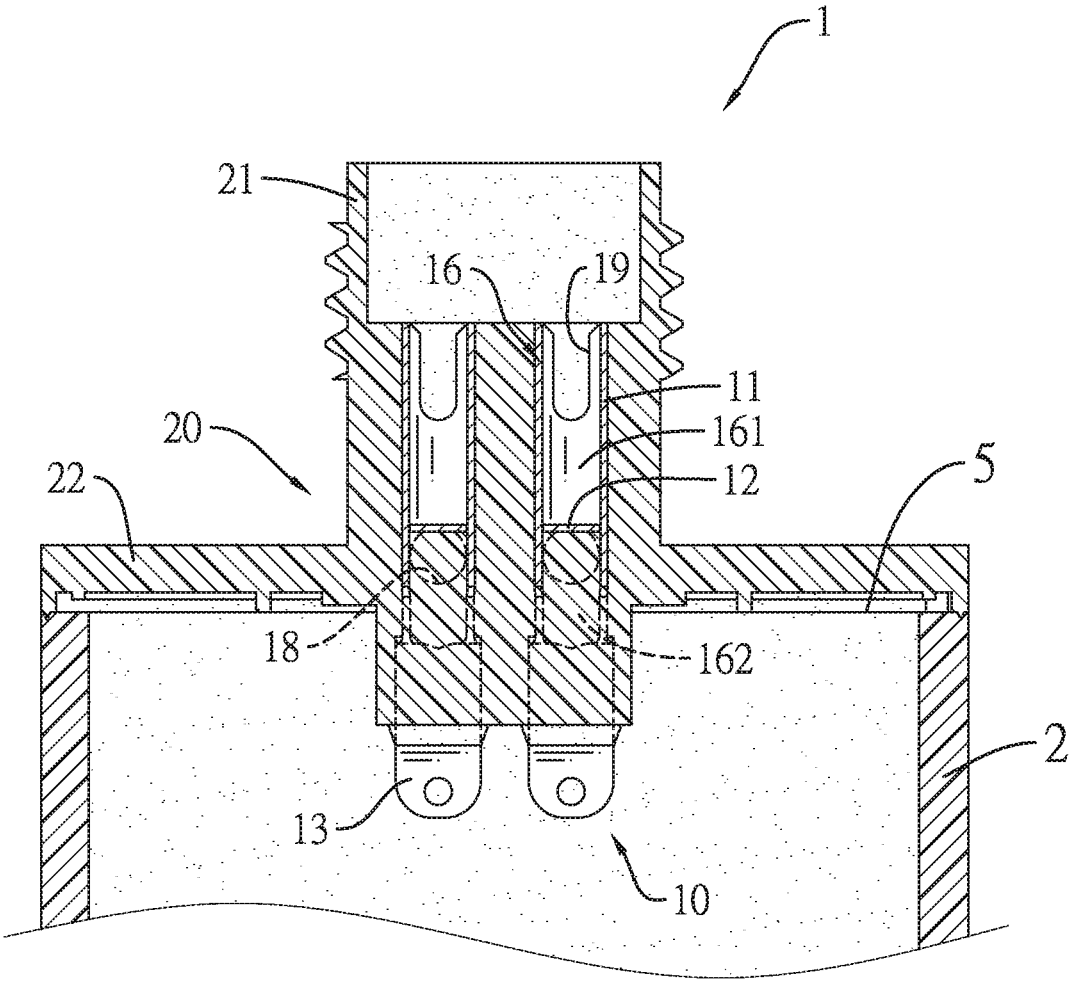
FIG. 3 is a cross sectional side view of the plug along line 3-3 in FIG. 2.

With reference to FIGS. 1 to 3, a plug in accordance with the present invention has a seat 2, a circuit board 3, and the waterproof terminal connector 1.

The seat 2 has two end surfaces, two pins 4, and a connecting opening 5. The two pins 4 are disposed on one of the two end surfaces of the seat 2. The circuit board 3 is disposed in the seat 2 and is electrically connected to the two pins 4. The waterproof terminal connector 1 is disposed on the seat 2 and seals the connecting opening 5 of the seat 2.

Figure 4:
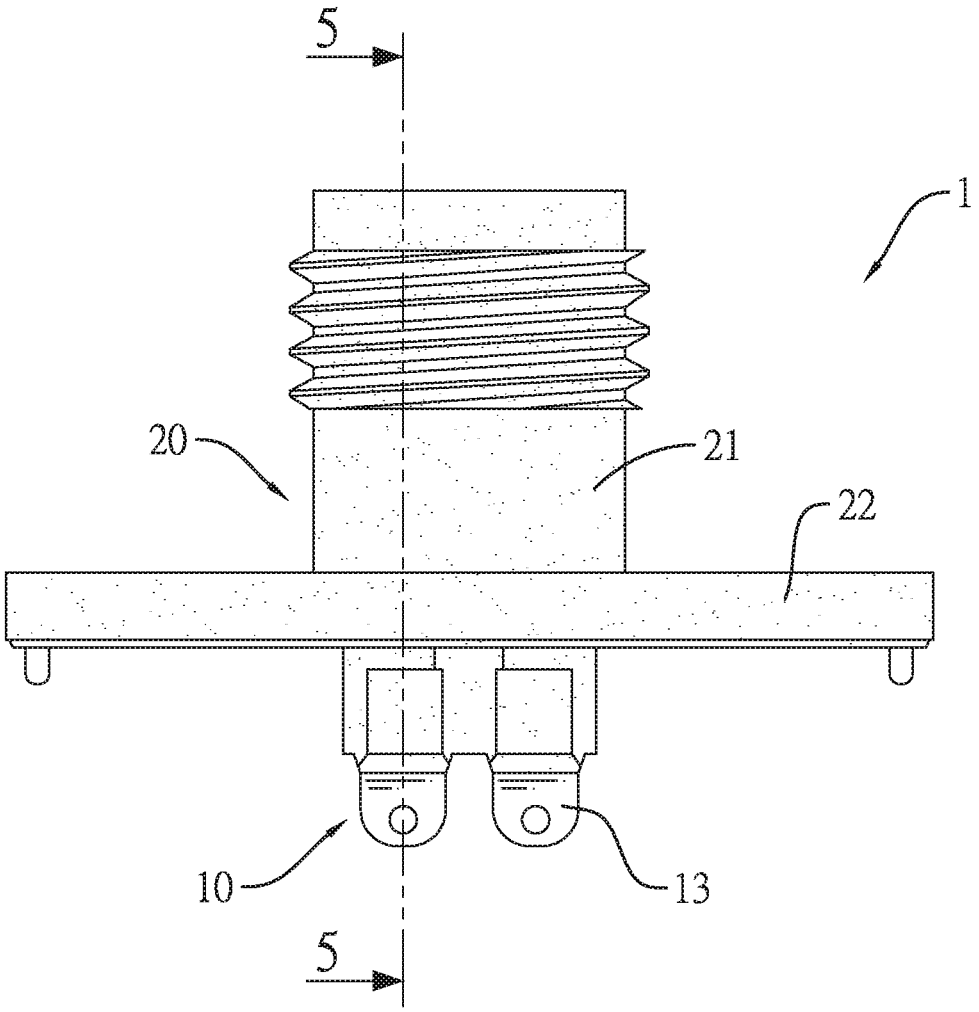
FIG. 4 is a front side view of a waterproof terminal connector of the plug in FIG. 3.
Figure 5:
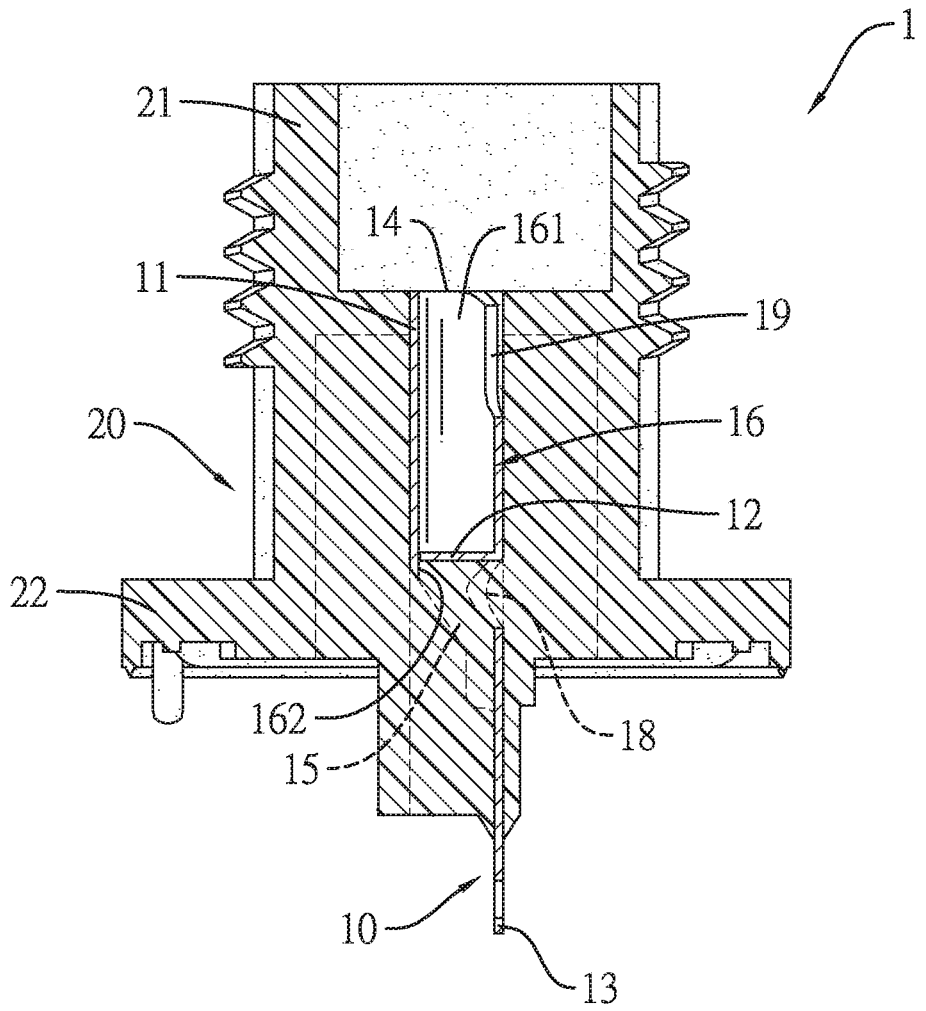
FIG. 5 is a cross sectional side view of the waterproof terminal connector of the plug along line 5-5 in FIG. 4.
Figure 6:
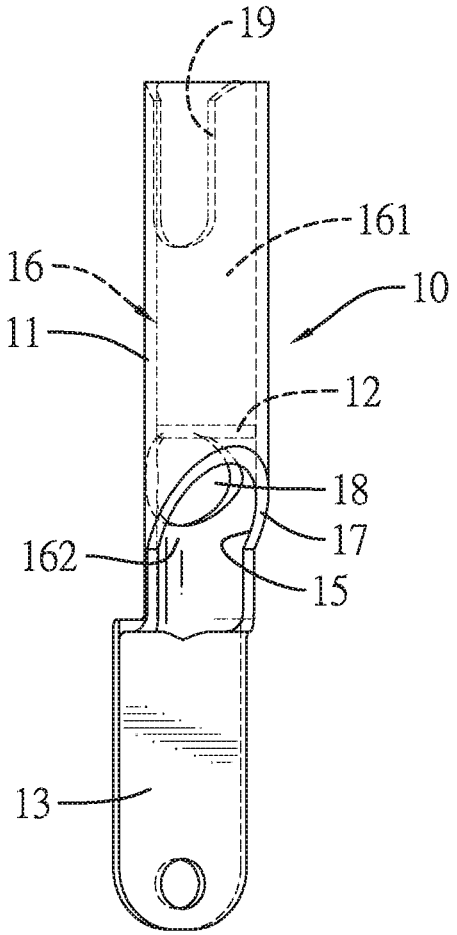
FIG. 6 is a front view of a terminal of the waterproof terminal connector of the plug in FIG. 4.
Figure 7:
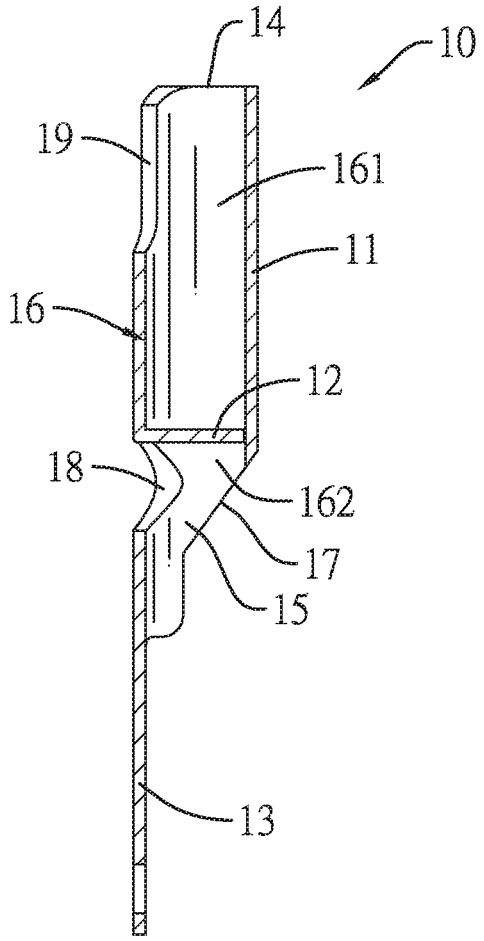
FIG. 7 is a cross sectional side view of the terminal of the waterproof terminal connector of the plug in FIG. 6.

With reference to FIGS. 4 and 5, a waterproof terminal connector 1 has two terminals 10 disposed at a spaced interval and a cover 20.

With reference to FIGS. 2, 3, 6 and 7, each one of the two terminals 10 has a tube portion 11, a division plate 12, and a connecting portion 13. The tube portion 11 has an inner surface, two end surfaces, a first opening 14, a second opening 15, and a chamber 16. The first opening 14 and the second opening 15 are respectively formed through the two end surfaces of the tube portion 11. The chamber 16 is formed in the tube portion 11. The division plate 12 is formed in the tube portion 11 and has an outer surface connected to the inner surface of the tube portion 11 for dividing the chamber 16 of the tube portion 11 into a first space 161 and a second space 162. The first space 161 communicates with the first opening 14. The second space 162 communicates with the second opening 15. The connecting portion 13 is formed on the tube portion 11 adjacent to the second opening 15 of the tube portion 11, protrudes out of the cover 20, and is inserted into the seat 2.

With reference to FIGS. 4 and 5, the cover 20 is formed by an overmolding process, is connected to the two terminals 10, and fills the second spaces 162 of the two terminals 10. The connecting portions 13 of the two terminals 10 protrude out of and are exposed from the cover 20. Furthermore, the cover 20 has a body 21 and a flange 22. The body 21 is connected around the two terminals 10. The connecting portions 13 of the two terminals 10 protrude out of the body 21 of the cover 20. The flange 22 is formed on and laterally extends from the body 21 of the cover 20.

In each one of the two terminals 10, the tube portion 11 has a through hole 18. The through hole 18 is formed through the tube portion 11 and communicates with the second space 162. The cover 20 extends through the through hole 18 when the cover 20 fills the second space 162 for increasing the assembling stability between the cover 20 and the terminal 10. The tube portion 11 has a notch 19. The notch 19 is formed in the tube portion 11, communicates with the first space 161, and extends to the first opening 14. The tube portion 11 has an inclined surface 17. The inclined surface 17 is formed on the tube portion 11 adjacent to the second opening 15.

In each one of the two terminals 10 of the waterproof terminal connector 1, the part of the cover 20 fills the second space 162 of the terminal 10 to form a first waterproof protection. Water vapor can hardly flow into the second space 162 of the terminal 10. The division plate 12 is disposed in the tube portion 11 of the terminal 10, and the outer surface of the division plate 12 is completely connected to the inner surface of the tube portion 11. The first space 161 is not in communication with the second space 162 due to the division plate 12. The division plate 12 can stop the water vapor to form a second waterproof protection. After the waterproof terminal connector 1 is disposed on the seat 2, the water vapor is prevented from flowing into the seat 2 by the filled second space 162 and the division plate 12.

Accordingly, the waterproof terminal connector 1 provides the first waterproof protection and the second waterproof protection. The second waterproof protection formed by the division plate 12 can provide a good waterproof effect. The waterproof effect of the plug is improved.

What is claimed is:

1. A plug comprising:

a seat having
- two end surfaces;
- two pins disposed on one of the two end surfaces of the seat; and
- a connecting opening formed through the other one of the two end surfaces of the seat;

a circuit board disposed in the seat and electrically connected to the two pins; and a waterproof terminal connector disposed on the seat, sealing the connecting opening of the seat, and having two terminals disposed at a spaced interval, and each one of the two terminals having
- a tube portion having
  - an inner surface;
  - two end surfaces opposite each other;
  - a first opening formed through one of the two end surfaces of the tube portion;
  - a second opening formed through the other one of the two end surfaces of the tube portion; and
  - a chamber formed in the tube portion;
- a division plate formed in the tube portion and having an outer surface connected to the inner surface of the tube portion completely for dividing the chamber of the tube portion into a first space and a second space, the first space communicating with the first opening, and the second space communicating with the second opening; and
- a connecting portion formed on the tube portion adjacent to the second opening of the tube portion; and a cover formed by an overmolding process, connected to the two terminals, and filling the second space of the two terminals, wherein the connecting portions of the two terminals protrude out of the cover and are inserted into the seat.

2. The plug as claimed in claim 1, wherein in each one of the two terminals, the tube portion has a through hole, and the through hole is formed through the tube portion and communicates with the second space.

3. The plug as claimed in claim 2, wherein the cover has a body connected around the two terminals, wherein the connecting portions of the two terminals protrude out of the body of the cover; and a flange formed on and laterally extending from the body of the cover.

4. The plug as claimed in claim 2, wherein in each one of the two terminals, the tube portion has a notch, and the notch is formed on the tube portion, communicates with the first space, and extends to the first opening.

5. The plug as claimed in claim 2, wherein in each one of the two terminals, the tube portion has an inclined surface, and the inclined surface is formed on the tube portion adjacent to the second opening.

6. The plug as claimed in claim 1, wherein the cover has a body connected around the two terminals, wherein the connecting portions of the two terminals protrude out of the body of the cover; and a flange formed on and laterally extending from the body of the cover.

7. The plug as claimed in claim 1, wherein in each one of the two terminals, the tube portion has a notch, and the notch is formed on the tube portion, communicates with the first space, and extends to the first opening.

8. The plug as claimed in claim 1, wherein in each one of the two terminals, the tube portion has an inclined surface, and the inclined surface is formed on the tube portion adjacent to the second opening.

* * * * *